United States Patent [19]

Goh

[11] Patent Number: 4,761,090

[45] Date of Patent: Aug. 2, 1988

[54] TUBULAR WRITING PEN TIP WITH ADJUSTMENT MEANS

[75] Inventor: Djing-San Goh, Hamburg, Fed. Rep. of Germany

[73] Assignee: Koh-I-Noor Rapidograph, Inc., Bloomsbury, N.J.

[21] Appl. No.: 891,085

[22] Filed: Jul. 31, 1986

Related U.S. Application Data

[63] Continuation-in-part of Ser. No. 736,726, May 22, 1985, Pat. No. 4,662,769.

[30] Foreign Application Priority Data

Aug. 2, 1985 [DE] Fed. Rep. of Germany ..... 3527694

[51] Int. Cl.[4] ..... B43K 17/00; B43K 1/10; B43K 3/04

[52] U.S. Cl. ..... 401/259; 401/54; 401/116; 401/198; 401/260

[58] Field of Search ..... 401/258, 259, 260, 116, 401/75, 76, 198, 199, 54

[56] References Cited

U.S. PATENT DOCUMENTS

| | | | |
|---|---|---|---|
| 231,690 | 8/1880 | Sutherland . | |
| 1,122,559 | 12/1914 | Wade . | |
| 1,150,068 | 8/1915 | Schroeder . | |
| 1,461,823 | 7/1923 | Gartner . | |
| 1,853,042 | 4/1932 | Deli et al. | 401/76 |
| 1,913,662 | 6/1933 | Deli et al. | 401/116 |
| 2,392,840 | 1/1946 | De Groft . | |
| 2,565,556 | 8/1951 | Gruber | 401/116 |
| 2,778,337 | 1/1957 | Lovejoy | 401/116 |
| 3,115,118 | 12/1963 | Anderson et al. | 401/75 |
| 3,292,595 | 12/1966 | Young . | |
| 3,427,116 | 2/1969 | Riepe . | |
| 3,436,160 | 4/1969 | Lanoie . | |
| 3,468,611 | 9/1969 | Ward . | |
| 3,486,830 | 12/1969 | Bok . | |
| 3,535,050 | 10/1979 | Bok . | |
| 3,580,689 | 5/1971 | Riepe . | |
| 4,160,256 | 7/1979 | Dziuk . | |
| 4,218,153 | 8/1980 | Hashimoto . | |
| 4,224,000 | 9/1980 | Endres . | |
| 4,269,524 | 5/1981 | Hashimoto et al. . | |
| 4,362,410 | 12/1982 | Hashimoto . | |
| 4,382,706 | 5/1983 | Hashimoto et al. . | |
| 4,390,299 | 6/1983 | Mutschler . | |
| 4,408,921 | 10/1983 | Nagai . | |
| 4,662,769 | 5/1987 | Goh | 401/259 |

FOREIGN PATENT DOCUMENTS

| | | | |
|---|---|---|---|
| 1274929 | 8/1968 | Fed. Rep. of Germany . | |
| 17869 | 6/1913 | France | 401/116 |
| 953653 | 12/1949 | France | 401/75 |
| 1457459 | 9/1966 | France . | |
| 151438 | 10/1979 | Japan | 401/116 |
| 149734 | 12/1931 | Switzerland . | |
| 369981 | 7/1963 | Switzerland . | |
| 2063180 | 1/1980 | United Kingdom . | |

*Primary Examiner*—Steven A. Bratlie

*Attorney, Agent, or Firm*—David H. Semmes; Warren E. Olsen

[57] ABSTRACT

An improved tubular writing pen having a writing pen body (3) and a forepart (1) joined to it that holds in a forward direction a writing tube (5). The forepart (1) is revolvable, yet is installed axially non-dislocatably in the pen body (3) and in the latter is braced against dislocatability in a rearward direction by a support surface (14). A writing fluid conductor extends into the writing tube (5). A coupler element (7) is fastened to the writing conductor and stands in contact with a bearing surface of an adjuster element (4) when raised from the drawing surface, and which is screwed into the forepart (1) and held non-rotatable with respect to the forepart.

14 Claims, 4 Drawing Sheets

Fig. 1
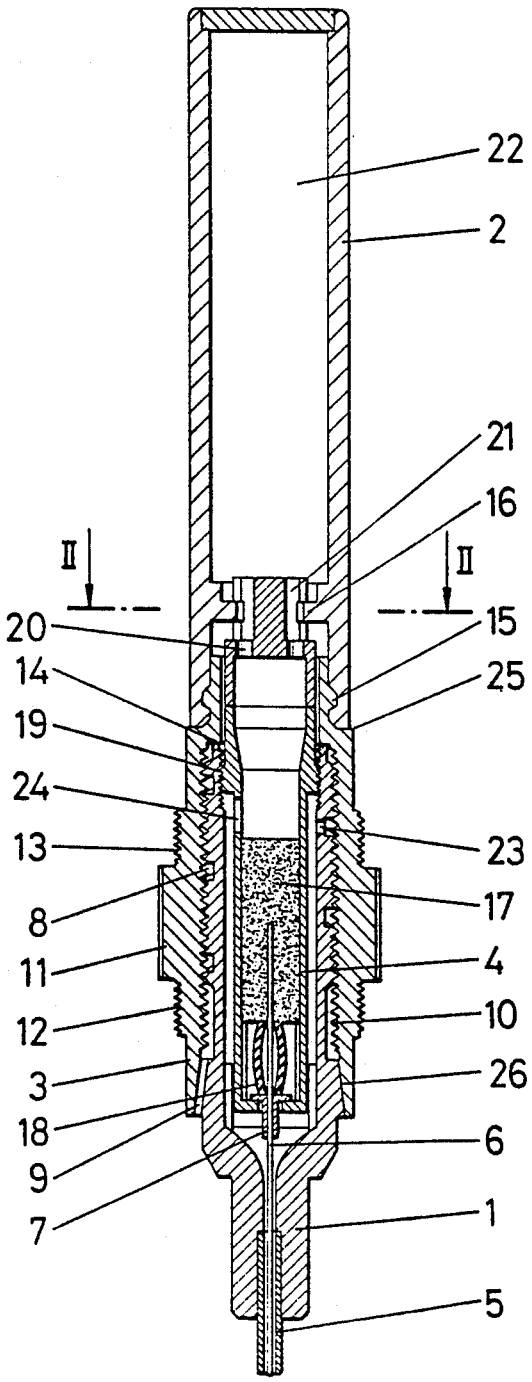
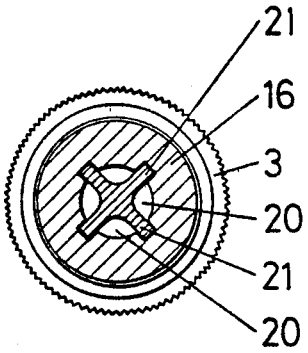
Fig. 2

Fig. 3
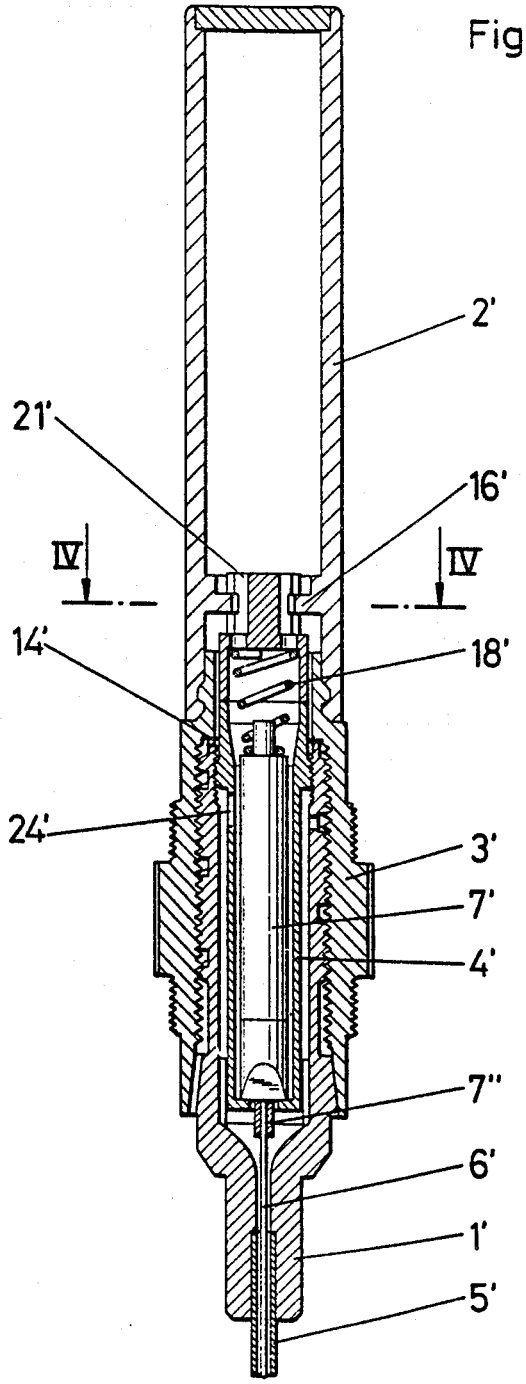
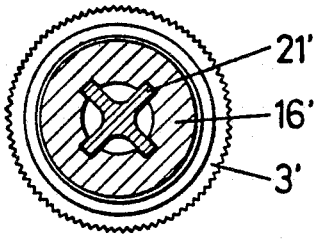
Fig. 4

Fig. 5
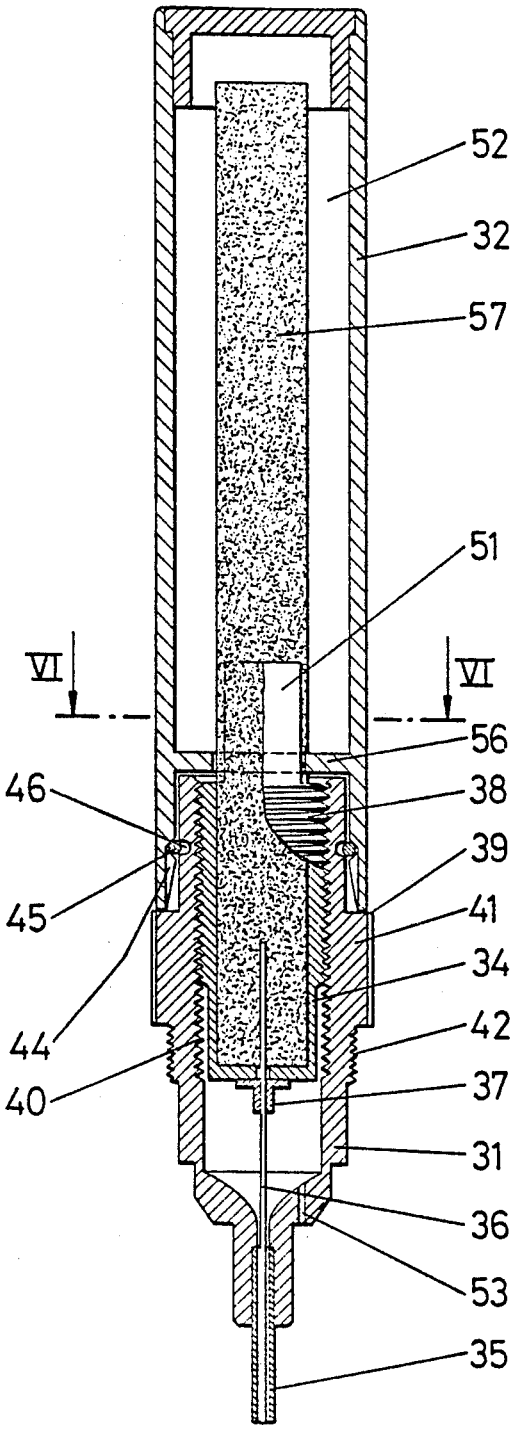
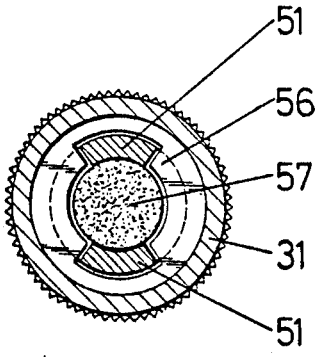
Fig. 6

Fig. 7
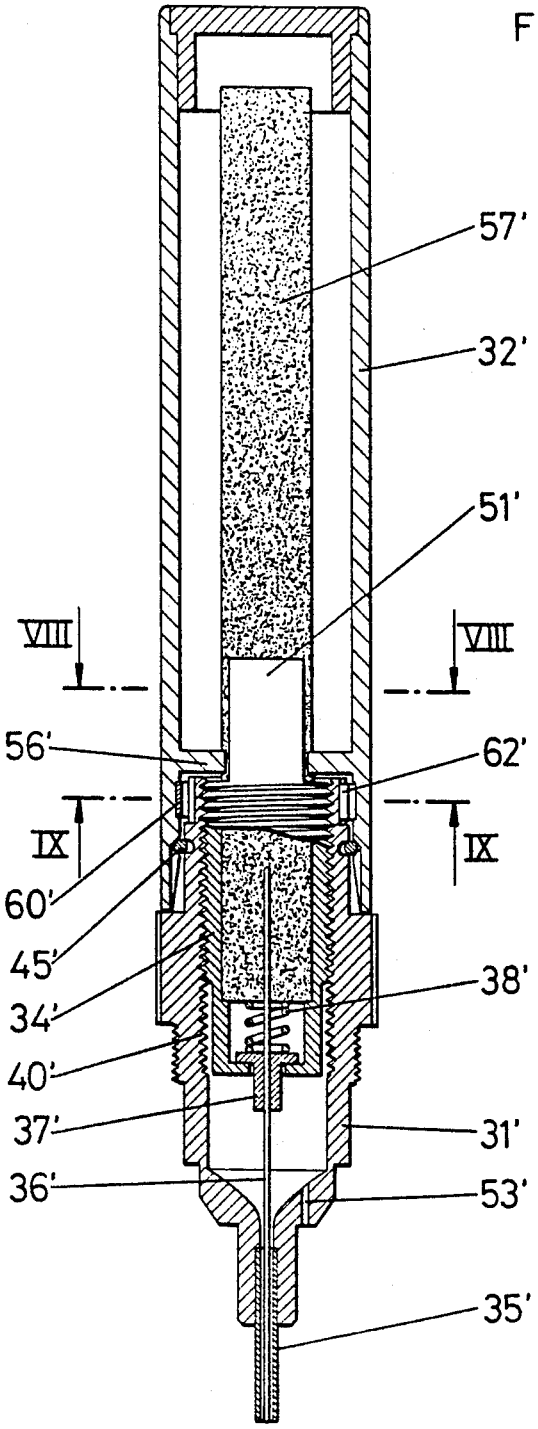
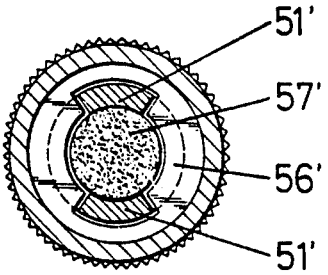
Fig. 8
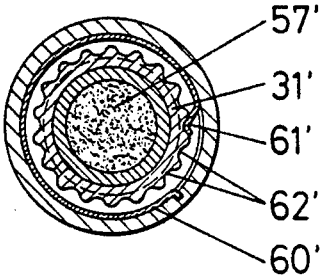
Fig. 9

TUBULAR WRITING PEN TIP WITH ADJUSTMENT MEANS

CROSS REFERENCE TO RELATED APPLICATIONS

This is a continuation-in-part of my copending application Ser. No. 06/736,726, filed May 22, 1985 now U.S. Pat. No. 4,662,769.

BACKGROUND OF THE INVENTION

1. Field of the Invention:

The present invention relates to a tip for a tubular writing pen having a forepart that contains a writing tube, secured to a pen body. Into the writing tube a writing fluid conductor extends which, during use, is in contact at its front end with the drawing surface, and is movable in an axial direction. A writing tube rearward end portion communicates with a reservoir of writing fluid. The writing tube is attached to a coupler element, which when lifted off the drawing surface, stands in contact with the bearing surface of an operating element, and which is adjustable in an axial direction in the front part through a screwing motion.

2. Brief Description of the Prior Art:

In a tubular writing pen tip according to the parent application (U.S. Pat. No. 4,662,769; German Patent Application P No. 34 18 954.8-27) the projection of the writing fluid conductor beyond the forepart end of the writing tube is not altered through impact stresses, since the adjustment of the writing tube conductor is carried out in an axial direction with relation to the writing tube by means of structural parts, whose position is not changed by impact stresses on the forepart.

By means of the present invention, further forms of tubular pen tips are described, in which the projection of a cleaning wire or other form of writing tube conductor beyond the forepart end of the writing tube will not be altered through impacts on the writing tube or on the forepart securing the writing tube.

OBJECT AND SUMMARY OF THE INVENTION

To attain this goal further tubular writing pens of the type discussed above are embodied such that the forepart is revolvable, but is inserted into the pen body in a non-dislocatable way. Further, the forepart is supported against dislocation toward the rear through a support surface, and an adjuster element is screwed into the forepart and is held firm in relation to the forepart.

Thus, in a tubular writing pen tip according to the present invention, the forepart is supported in an axial direction in a nondislocatable way, yet is revolvable. Rotation of the forepart in relation to a non-rotatable element (screwed into the forepart) has the consequence of altering the projecting length of the writing fluid conductor beyond the forepart end of the writing tube. Impact stresses on the writing tube have no effect on the projecting length of the writing tube conductor, since the forepart is braced against axial displacements to the rear by a supporting surface.

In one embodiment of the invention, the pen body is a socket element, screwed into engagement with a side of a writing fluid reservoir, and the adjuster element is in non-rotatable engagement with respect to a wall portion of the writing fluid reservoir.

If the socket element is revolved with respect to the side of the writing fluid reservoir, the adjuster element remains in a non-rotatable position, whereas the forepart rotates together along with the socket element. For this function it is required that the engagement between forepart and socket element comprises considerable friction, in the screw contact between forepart and adjuster element. Hence, in the case of a revolving of the socket element there will be a twisting of the forepart with respect to the engagement with a wall portion of the writing fluid reservoir, which is held in a non-rotatable way. By those means, an alteration of the writing fluid reservoir beyond the forepart end of the writing tube is effected.

The wall portion, with which the adjuster element interacts in non-rotatable engagement, may be formed by a sectional reduction. The wall portion may have grooves running axially parallel, into which fins, running axially parallel, extend.

The socket element may be connected in a rotatable way with the side of the writing fluid reservoir above a snap-on connector, comprising a snap ring and a snap ring groove, and supported by an annular shoulder at the forepart end of the side of the writing fluid reservoir. Hence, a twisting of the socket element with respect to the writing fluid reservoir does not lead to an axial dislocation of these parts.

In order to relocate the writing tube conductor into the writing tube, (from contact with a drawing surface) so that the forepart end surface of the writing tube lies on the drawing surface, and also to move the fluid conductor (while raising above the drawing surface) into a position of projection beyond the forepart end of the writing tube, the support surface for the coupler element can be turned toward the rear end of the adjuster element, with the coupler element pressed by spring force against the support surface. In this manner the dislocation of the writing tube conductor into the writing tube acts against spring pressure, and the spring pressure created by a lifting up from the drawing surface relocates the writing tube conductor into a forward position.

In order to employ this type of tubular writing pen tip as an india ink pen, the coupler element can be a falling weight body.

In a second embodiment of the invention, the writing pen body forms the writing fluid reservoir, and the adjuster element is in non-rotatable engagement with a wall portion of the writing fluid reservoir.

In this construction, a rotating of the forepart with respect to pen body occurs without an intervening switching of the socket element, whereas the adjuster element in this second embodiment execution stands in non-rotating engagement with a wall portion of the writing fluid reservoir. Thus the engaging portions of adjuster element and wall portions of the writing fluid reservoir can be developed appropriately.

The forepart and the pen body may be coupled by means of a slotted retaining ring, and the forepart can be supported at the forepart end of the pen body by means of an annular shoulder. In that manner, the forepart and pen body are rotatable against each other, yet the forepart is not dislocated axially toward the rear as a consequence of dropping the pen body or from other impact stresses.

In order to retract the writing tube conductor into the writing tube, when touching the pen to the drawing surface, so that the forepart end surface of the writing pen tube contact with the drawing surface, (and to extend again upon raising the pen from the drawing surface) the bearing surface for the coupler element may be turned toward the rearward end of the adjuster element, and the coupler element pressed by means of a spring force against the bearing surface.

It is also possible to employ friction for retaining the writing fluid conductor in the writing fluid reservoir, for a projection into an absorbent media comprising porous material as the bearing surface for the coupler element is turned toward the writing tube. In this embodiment, the coupler element supports the writing fluid conductor against axial movement from behind, while axial adjustment motion of the projection of the writing fluid conductor beyond the forepart end of the writing tube arises in the same manner as described above.

In order to be able to adjust the projection of the writing conductor in stages beyond the forepart end of the writing tube, an indexing spring can be provided between the forepart and the pen body. The spring may be fastened to one of these parts, and engage with lock recesses distributed in a circumferential direction.

The invention is explained in further detail in the following description of exemplary embodiments, wherein reference is made to the accompanying drawings.

BRIEF DESCRIPTION OF THE DRAWINGS

FIG. 1 is a partial, in section, plan view showing the tip of a tubular writing pen according to the invention.

FIG. 2 is a section taken along line II—II of FIG. 1.

FIG. 3 is a partial section plan view of a second embodiment.

FIG. 4 is a section taken along line IV—IV of FIG. 3.

FIG. 5 is a partial section plan view of a third embodiment.

FIG. 6 is a section taken along line VI—VI of FIG. 5.

FIG. 7 is a partial section plan view of a fourth embodiment.

FIG. 8 is a section taken along line VIII—VIII of FIG. 7.

FIG. 9 is a section taken along line IX—IX of FIG. 7.

DESCRIPTION OF THE PREFERRED EMBODIMENTS

The tubular writing pen tip embodiment depicted in FIGS. 1 and 2 has a forepart 1 essentially in the shape of a writing cone, and to this forepart end is fastened a writing tube 5. On the external surface of the forepart 1 is located a tightening thread as well as a spiral shaped, pressure equalization chamber 8, which is connected over a cross bore 23 with an internal chamber of the forepart 1.

The forepart 1 is screwed into the socket element 3 and is supported by means of overhangs 26 on the internal surface of the socket element, by which means forepart 1 is secured against wobbling. Between the overhangs 26 is the equalization chamber 8, connected by channels 9 with the ambient air. With its rearward end surface the forepart is supported sealingly on an annular shoulder 14 of the socket element.

The socket element 3 is inserted at its rearward end, by means of a ring 15, into the circumferential side of a writing fluid reservoir 2 that is enclosed at its rearward end and has an annular groove to receive the ring 15. The connection can take place simply by snapping the elements together. An annular shoulder 25 of the socket element 3 is supported by the forepart end of the circumferential wall 2 of the writing fluid reservoir, so that the socket element 3 is rotatable opposite the writing fluid reservoir, but is axially positioned in a non-dislocatable manner toward the rear.

In the rearward end 19 of the forepart 1, a hollow adjuster element 4 is screwed in and extends foreward from the forepart 1 into the vicinity of a transition range to the connection with a writing tube 5. The internal space of the adjuster element 4 is connected with the internal bore of the forepart 1 over a cross hole 24 and through this means via a cross hole 23 into the equalization chamber 8. Hence, an equalization of pressure occurs in the event of warming or fluid consumption even inside the adjuster element.

At the rearward end the adjuster element 4 is connected through channels 20 with the writing fluid reservoir supply space 22, which is enclosed at the rearward end, whereby the channels 20 are delimited by axially parallel running fins 21. These fins stand engaged with slits developed in a wall portion 16 that are formed by means of a reduced cross section in the side of the writing fluid reservoir. In this manner the adjuster element 4 is retained for axial movement in a non-rotating manner opposite the writing fluid reservoir, while its interior space is in contact with the supply space of the writing fluid reservoir.

Into the adjuster element 4 is inserted a tampon 17 of open porous material, which may comprise a pressed fibrous material that absorbs writing fluid from the supply space 22. Extending in a forward direction into this tampon 17 is the writing fluid conductor 6, which may comprise, for example, an open porous material. A middle bore is present in the front transverse running end wall of the adjuster element 4, through which the writing conductor 6 extends in a forward direction into the writing tube 5. In the area of the middle bore, a T-shaped cross-section coupler element 7 may be attached, as by gluing. The flange of the coupler element 7 lies on the internal surface, i.e. on the rearward surface of the forward transverse wall of the adjuster element 4. It is pressed against this end surface by a tube shaped spring element 18 made of synthetic material or natural rubber, since the spring element 18 is braced at its rearward end on a tampon 17 that is held inside the hollow adjuster element 4 in an axially non-dislocatable manner.

If the writing tube 5 of the tubular writing pen tip is set down upon a drawing surface, the projecting forward end of the writing fluid conductor 6 is dislocated against the pressure of the spring element 18 toward the rear, so that the forepart end plane of the writing tube 5 rests upon the drawing surface. By this means there ensues a shifting of the writing fluid conductor 6 further into the tampon 17.

When the tubular writing pen tip is raised from the drawing surface, the spring element 18 urges the coupler element 7 in a forward direction until there is contact by the above indicated resting place of its flange portion on the forepart wall of the adjuster element 4. The original projected length of the writing fluid conductor 6 then is restored again above the forepart end of the writing tube 5.

In order to change this projected length of the writing fluid conductor 6 beyond the forepart end of the writing tube, socket element 3 and along with it the forepart 1 are revolved, so that the forepart 1 revolves around its threaded engagement with the adjuster element 4. As a result, engagement of its fins 21 with the grooves in the wall portion 16 of the writing fluid reservoir holds it in a non-rotatable manner. For this to occur, of course, the friction of the thread engagement between socket element 3 and forepart 1 is greater than the friction between the screw thread engagement of forepart 1 and the adjuster element 4 in portion 19. By means of the rotation of the forepart 1 with respect to the adjuster element 4, an axial dislocation of the adjuster element 4, (together with the writing fluid conductor 6) is effected because of the axial non-dislocatability of the socket element 3 and forepart 1 as both parts rotate with respect to writing fluid reservior wall, 16. Consequently, there is a change in the projected length of the writing fluid conductor 6 beyond the forepart of the writing tube 5.

Since, as already described, the forepart 1 rests with its rearward end on the annular shoulder 14 of the socket element 3, any impacts upon the writing tube 5 or the forepart 1 will not result in axial dislocation of the forepart 1 with respect to the socket element 3. The socket element is supported in turn above its annular shoulder 14 at the forward end of the writing fluid reservoir.

It should be mentioned that the socket element 3 exhibits a collar 11, located to the front of thread 12 and behind thread 13. The threads 12 and 13 can be used for the purpose of fastening te tubular writing pen tip into the mounting of a plotter which then holds the tubular writing pen tip securely at both front and rear ends by means of screw like engagement with the threads 12 and 13, as well as through a clamping of the collar 11.

The second tubular writing pen tip embodiment of FIGS. 3 and 4 is different from the tubular writing pens of FIGS. 1 and 2 soley by means of the development of the coupler element, and its spring impact. In the tubular writing pen tip shown in FIGS. 3 and 4, the coupler element has the form of a falling weight body 7', with conducting sockets 7'' that are fastened at the forward end and extend through the center bore of the forward transverse wall of the adjuster element 4'. By means of this conducting socket 7'', the writing fluid conductor 6' extends into the falling weight body 7'' and is fastened therein.

At its rearward end, the falling weight body 7' exhibits a cylinder shaped driver which guides one end of a coil spring 18'. One end of the coil spring supports the rear end of falling weight body 7', and the other presses against a rearward surface of the adjuster element 4'. Thereby, the falling weight body 7' is forced in a forward direction into a position wherein its forward surface rests upon the internal surface of a forward transverse wall of the adjuster element 4'. The spring 18' performs the same function and mode of action as spring element 18 of the tubular writing pen tip shown in FIGS. 1 and 2.

In the third tubular writing pen tip embodiment represented by FIGS. 5 and 6, a front end of the forepart 31, bears a writing tube that is inserted into the forward end of a writing tube reservoir. A slit catch spring 45 serves as connector. It is supported on one side in a snap ring groove 46 of the forepart 31 and, on the other, in a ring groove in the circumferential wall 32 of the writing tube reservoir that is enclosed at its rearward end, as well as by the developed overhangs 44. In the portion of the annular shoulder in the circumferential wall 32, the spring 45 also stands in engagement with the snap ring groove 46 in the forepart 31, so that in this manner a revolving connection between forepart 31 and writing fluid reservoir is produced. In other respects, the forepart 31 is supported by an annular shoulder 39 at the forward end of the circumferential wall 32 of the writing fluid reservoir, so that an axial dislocation of the forepart 31 toward the rear with respect to the writing fluid reservoir is not possible.

In the internal bore of the tapered shaped forepart 31, an internal thread 40 has been developed into which an adjuster element 34 is screwed from behind with an external thread 38. This adjuster element is open from the rear and exhibits two fins or elongations 51 extending in a rearward direction into slots or recesses in a wall portion 56, formed by means of transverse section diminution of the writing fluid reservoir. In this manner, the adjuster element 34 is secured against twisting with respect to the writing fluid reservoir.

A tampon 57 of open porous material, such as pressed fibrous material corresponding in composition to the tampon 17 of FIGS. 1 and 2, fills out the interior space of the adjuster element 34, and is inserted into this space to extend in a rearward direction into supply space 52 of the writing fluid reservoir.

The center bore in the forward transverse wall of the adjuster element 34 retains a writing fluid conductor 36, that may comprise, for example, a pressed, porous material and is held in a nondislocatable manner in tampon 57. In order to prevent the writing fluid conductor 36 from being pressed into the tampon 57 when setting down the projecting end beyond the forward end of the writing tube 35 onto the writing or drawing surface, a T-shaped cross-section coupler element 37 fixedly is attached, as by gluing. The rearward surface of the flange in the coupler element 37 lies on the forward surface of the forward transverse wall of the adjuster element 34.

In order to change the projection of the writing fluid conductor 36 beyond the forward end of the writing tube 35, (particularly to adjust for abrasion of the writing fluid conductor 36), the forepart 31 is rotated as needed. Since the forepart 31 is axially supported in a non-dislocatable manner with an annular shoulder 39 at the forward end of the writing fluid reservoir, and since the adjuster element 34 is held non-rotatably in the writing fluid reservoir, the adjuster element 34 is "screwed in" through such a twisting motion as a consequence of the engagement of the thread 38 and 40, and moves further into the forepart 31. In this manner, the writing fluid conductor 36, also axially is positioned into the forward direction, especially since the coupler element 37 prevents the writing fluid conductor 36 from being pressed further into the tampon 57.

It should be mentioned that the tubular writing pen tip shown in FIGS. 5 and 6 can be screwed into the mounting arm of a plotter through the use of external thread 42, whereupon it will rest on the mounting means of the annular shoulder developed by flange 41.

The fourth embodiment of a tubular writing pen tip shown in FIGS. 7 and 9 conforms in the main with the third embodiment tubular writing pen tip, as shown in FIGS. 5 and 6. For this reason identical or comparable parts are shown with the same numerical designators and are distinguished by a "'".

A major difference between the tubular writing pen tip of FIGS. 5 and 6 and that of FIGS. 7 and 9, lies in the arrangement and bracing of the coupler element 37'. This coupler appropriately is struck open through the force of a coil spring 38' from the coupler element 7 of the tubular writing pen tip, as shown in FIGS. 1 and 2. The spring lies in the same position and works in identical fashion as the spring element 18 of the tubular writing pen tip shown in FIGS. 1 and 2.

Further, FIGS. 7 and 9 show two equally divided recesses that are developed in the tubular writing pen tip, at the rearward end of the forepart 31' and in the external circumferential surface. A spring 60' is provided on the internal side of the circumferential wall of the writing fluid reservoir located next to catch recesses 62', which rest upon an internal circumferential surface. The internal thread thereof is tapered down and fastened in a groove of the circumferential side 32'. A free end 61' (FIG. 9) of the spring 60' is radially bent inward and is somewhat rounded off, so that its form conforms to that of the catch recesses 62'.

As will now be apparent without further explanation, a twisting of the forepart 31' with respect to the writing fluid reservoir effects a crossover of the free end 61' of the spring 60' into a neighboring catch recess 62'. Hence, a steplike crossover from one position of the forepart 31' occurs with respect to the circumferential wall 32' of the writing fluid reservoir, for each succeeding position. By means of such a catch regulation, the user has a reference for the degree of the twist undertaken, and by this means a reference for the length of projection of the writing fluid conductor 36' beyond the forward end of the writing tube 36'.

While preferred embodiments of the invention have been described, the invention is to be defined by the scope of the appended claims.

I claim:

1. In a tubular writing pen having a writing fluid reservoir (2); a writing pen body (3;3'';32;32') a forepart (1;1';31;31') that holds at its front a writing tube (5;5';35,35') into which a writing fluid conductor (6; 6';36;36') extends, so as to project forwardly for contact by a forward end with a drawing surface, and rearwardly for contact by a rearward end with said reservoir of writing fluid, the improvement which comprises, in combination said writing fluid conductor being fastened to a coupler element (7;7';7'';37;37'') so that, when the writing tube is raised from the drawing surface, the coupler element makes contact with a bearing surface of an adjuster element (4;4';34;34') that is axially movable with respect to the forepart (1;1';31;31') by means of a threaded engagement with said pen body, a forepart (1;1';31;31') that is mounted from the front end into an axially fixed position with respect to the writing pen body (3;3';32;32') wherein the forepart is braced against further axial movement toward the rear by a writing pen body bearing surface (14;14') wherein further said adjuster element (4;4'; 43;34') is not rotatable with respect to the writing fluid reservoir (2) but is axially positioned selectively with respect to the writing pen body (3;3'';32;32') by a rotation of the forepart (1;1';32;31') which is rotatable but is axially fixed with respect to said writing fluid reservoir.

2. A tubular writing pen tip according to claim 1, wherein the writing pen body further comprises a socket element (3;3') connected for rotation but axially fixed with respect to a surface of a writing fluid reservoir (2;2') wherein further the adjuster element (4;4') stands in nondislocatable engagement with a wall portion of the writing fluid reservoir (16;16').

3. A tubular writing pen tip according to claim 2, wherein the wall portion (16;16') is formed by a reduction in cross-section.

4. A tubular writing pen tip according to claim 3, wherein the wall portion (16;16') further comprises axially parallel running slots into which extend axially parallel running fins (21;21;) of the adjuster element (4;4') to prevent rotation between the adjuster element and the writing pen body.

5. A tubular writing pen tip according to claim 2, wherein the socket element (3;3') is connected with a surface of the writing fluid reservoir (2) to define a snap-on connection which comprises a ring (15) and a snap ring groove, and is braced against an annular shoulder (25) at a surface which is proximate a forward end of the writing fluid reservoir (2).

6. A tubular writing pen tip according to claim 2 wherein a forward facing bearing surface of said coupler element (7;7';7'') makes contact with a rearward facing bearing surface of the adjuster element (4;4') and by means of a spring force the coupler element normally is pressed against the bearing surface.

7. A tubular writing pen tip according to claim 2, wherein the coupler element comprises a falling weight body and the writing fluid conductor comprises a cleaning wire (7';7'').

8. A tubular writing pen tip according to claim 1, wherein the writing pen body (32;32') comprises a writing fluid reservoir, and the adjuster element (34;34') is in an axially movable but non-rotatable engagement with a wall portion (56;56') of the writing fluid reservoir (32;32').

9. A tubular writing pen tip according to claim 8, wherein the reservoir wall portion (56;56') is formed by a reduced cross section.

10. A tubular writing pen tip according to claim 9, wherein axially parallel running slots are provided in the reduced cross section reservoir wall portion (56;56') into which extend axially parallel fins (51;51') of the adjuster element (34;34').

11. A tubular writing pen tip according to claim 8, wherein the forepart (31;31') and the writing pen body (32;32') are coupled by means of a slotted spring ring (45;45') and the forepart (31) is braced against axial movement at a forward end of the writing pen body (32) through an annular shoulder (39).

12. A tubular writing pen tip according to claim 8 wherein a forward facing surface of said coupler element (37') makes contact with a rearward facing surface of the adjuster element (34') and the coupler element (37') normally is pressed against the bearing surface by means of spring force.

13. A tubular writing pen tip according to claim 8 wherein the writing fluid conductor (36) rearward end is retained axially by means of friction within the writing fluid reservoir, and the bearing surface for contact with the coupler element (37) faces forwardly toward the writing tube (35).

14. A tubular writing pen tip according to claim 8 wherein a catch spring fastener (60') is provided between forepart (31') and writing pen body (32'), wherein a catch spring free end comes into contact with notched recesses (62') around a circumference of said forepart.

* * * * *